United States Patent [19]

Ovenden et al.

[11] Patent Number: 4,994,959

[45] Date of Patent: Feb. 19, 1991

[54] FUEL BURNER APPARATUS AND A METHOD OF CONTROL

[75] Inventors: Neil A. Ovenden, Dartford, England; Tsuyoshi Kimura, Yamatoshi; Keiichi Minamino, Matsubarashi, both of Japan

[73] Assignees: British Gas plc, London, England; Osaka Gas Co., Osaka; Tokyo Gas Co. Ltd., Tokyo, both of Japan

[21] Appl. No.: 278,004

[22] Filed: Nov. 30, 1988

[30] Foreign Application Priority Data

Dec. 3, 1987 [GB] United Kingdom ..... 8728327

[51] Int. Cl.[5] ..... G05B 13/02; F23N 1/00; F23N 15/00

[52] U.S. Cl. ..... 364/153; 236/15 BD; 431/12

[58] Field of Search ..... 364/137, 141, 148, 152, 364/153, 154, 166, 172, 173, 183, 477, 494; 431/12, 14, 18, 76; 110/185, 186, 188, 191; 236/15 R, 15 BD

[56] References Cited

U.S. PATENT DOCUMENTS

| | | | |
|---|---|---|---|
| 4,261,508 | 4/1981 | Broach | 236/15 BD |
| 4,330,260 | 5/1987 | Jorgensen et al. | 431/12 |
| 4,360,336 | 11/1982 | Shepherd | 431/12 |
| 4,369,026 | 1/1983 | Morgan et al. | 431/12 |
| 4,516,929 | 5/1985 | Hiroi et al. | 431/12 |
| 4,531,905 | 7/1985 | Ross | 431/12 |
| 4,540,009 | 10/1985 | Muraki et al. | 431/12 |
| 4,568,266 | 2/1986 | Bonne | 431/12 |
| 4,583,936 | 4/1986 | Krieger | 431/12 |
| 4,676,734 | 6/1987 | Foley | 431/12 |

FOREIGN PATENT DOCUMENTS

| | | |
|---|---|---|
| 8402402 | of 1984 | PCT Int'l Appl. . |
| 8402403 | of 1984 | PCT Int'l Appl. . |

*Primary Examiner*—Jerry Smith
*Assistant Examiner*—Jim Trammell
*Attorney, Agent, or Firm*—St. Onge Steward Johnston & Reens

[57] ABSTRACT

An air-fuel ratio programmable control method for a fuel burner installation, and a fuel burner installation adapted to operate by the control method. In the method, an error (Ep) is determined by subtraction of an input (Po) representative of the existing firing rate and an input (Pn) representative of the required firing rate; depending on whether Ep is positive or negative, fuel and air supplies to the burner are modulated in either air-led or fuel-led manner, respectively, to set the firing rate to the desired value (Pn); in addition, the error (Ep) is compared to a predetermined breakpoint (Xp) so that if Ep exceeds Xp fuel and air supplies to the burner can be modulated simultaneously for fast control action.

9 Claims, 7 Drawing Sheets

MONITORING TERMINAL
20
CONTROL PROGRAM
13
MICROPROCESSOR-BASED CONTROL UNIT
12
ANALOGUE TO DIGITAL
11
RELAY
14
SPARK GENERATOR
15
RELAY
17
GAS SUPPLY ON/OFF VALVE
16
DIGITAL TO ANALOGUE
18
DIGITAL TO ANALOGUE
19
FAN SPEED CONTROL
4
MODULATING VALVE
2
FAN
3
BURNER
1
OXYGEN SENSOR
5
10
21
6
7
8
9

FUEL BURNER APPARATUS AND A METHOD OF CONTROL

BACKGROUND OF THE INVENTION

This invention relates to air-fuel ratio control for a fuel burner installation and is particularly concerned with such systems for domestic use e.g. for water heating or space heating purposes.

DESCRIPTION OF THE PRIOR ART

Conventional heating systems for domestic use have been controlled on an on-off basis as a means of adjusting to the system load.

It has been proposed to provide a gas heating system comprising a forced draught fully premixed gas burner and to modulate the gas and air supply to the burner in response to load requirements and to control the air/gas ratio to maintain satisfactory operation.

In industrial applications it has been common practice to maintain air/fuel ratios constant by means of a so-called zero governor system but this has been found to be impractical for domestic systems. It is also known in industrial practice to control air/fuel ratios in response to combustion product sensors using a closed loop control.

SUMMARY OF THE INVENTION

It is an object to provide an improved control for a fuel burner system which is suitable for domestic use.

According to the invention there is provided a method of controlling a fuel burner by means of a programmed control unit arranged separately to modulate supplies of fuel and air to the burner, the method comprising the steps of:

(a) establishing an input Pn to the control unit representative of a required firing rate (b) establishing an input Po to the control unit representative of the existing firing rate (c) establishing in the control unit an error Ep where $Ep=Pn-Po$ (d) determining in the control unit whether Ep is positive, indicating a required increase, or negative, indicating a required decrease, in firing rate (e) if Ep is positive, modulating the fuel and air supplies to the burner in air led manner to set the firing rate to Pn (f) if Ep is, negative, modulating the fuel and air supplies to the burner in fuel led manner to set the firing rate to Pn, and (g) after establishing Ep, comparing the modulus of Ep with a predetermined break point Xp and if $/Ep/\geqq Xp$, modulating the fuel and air supplies to the burner simultaneously.

The invention includes a fuel burner installation including a fuel burner, air supply means, fuel supply means, modulating means for the air supply, modulating means for the fuel supply, a programmed control unit arranged to modulate the fuel and air supplied to the burner by control of the modulating means, means for establishing an input Po to the control unit representative of an existing firing rate of the burner, means for establishing an input to the control unit representative of a required firing rate Pn of the burner, the control unit being programmed to establish the error $Ep=Pn-Po$ between the required and existing firing rate and to modulate the modulating means in response to the magnitude of the error Ep in such manner that if the error Ep is positive the fuel and air supplies are increased in air led manner, and if the error Ep is negative the fuel and air supplies are decreased in fuel led manner and, after establishing Ep, to compare the modulus of Ep with a predetermined break point Xp and if $/Ep/\geqq Xp$ to modulate the air and fuel supplies to the burner simultaneously.

BRIEF DESCRIPTION OF THE DRAWINGS

The invention will now be described, by way of example, with reference to the accompanying partly diagrammatic drawings, in which.

DETAILED DESCRIPTION OF THE PREFERRED EMBODIMENT

Figure 1:
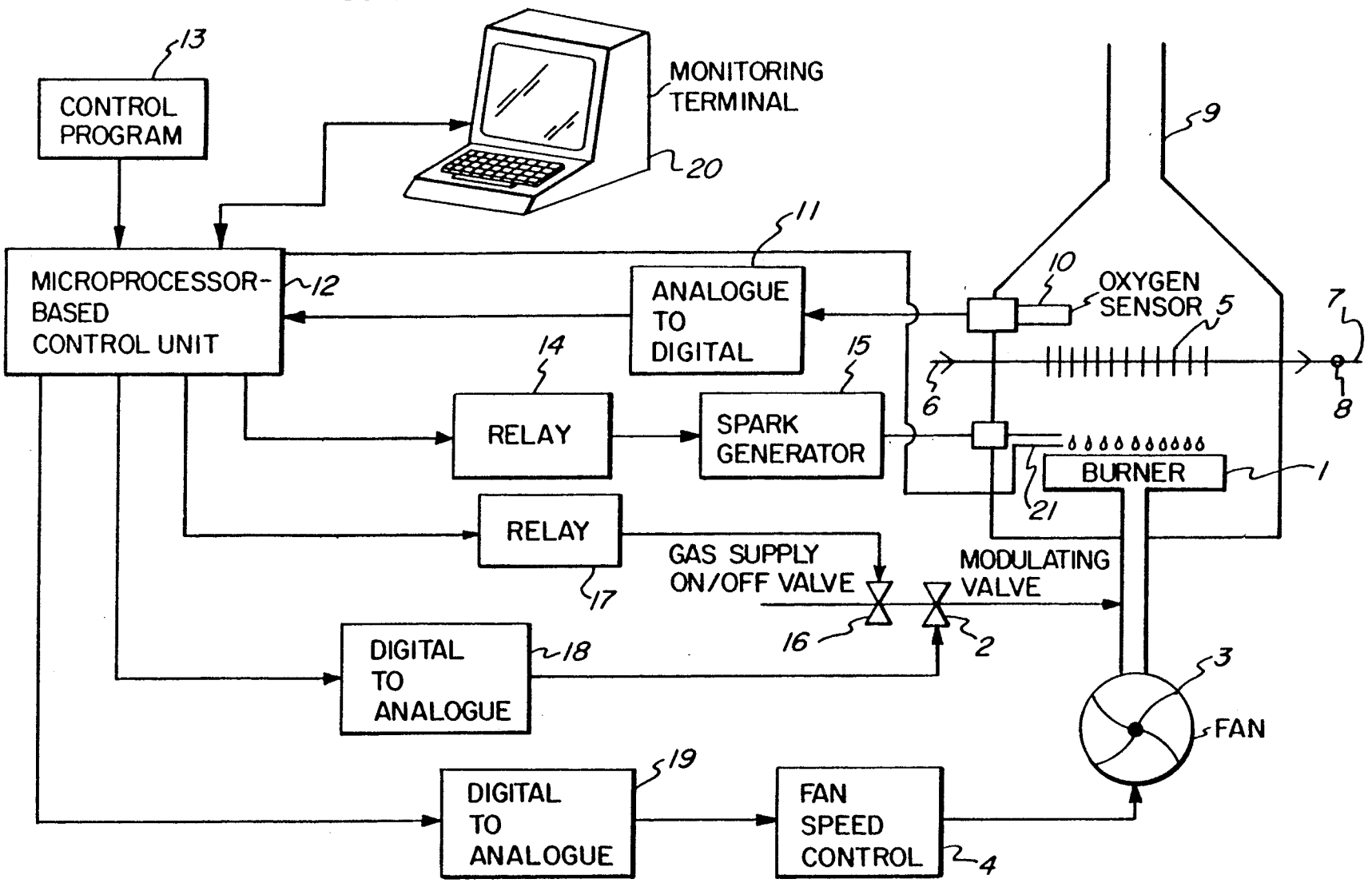
FIG. 1 is a block diagram of heating system showing the control system in schematic form.

The heating system of FIG. 1 comprises a domestic water heater having a fully premixed gas burner 1 supplied with gas through a modulating valve 2 and combustion air through a variable speed fan 3, suitably a laminar flow fan, having a fan-speed control unit 4. The burner 1 is suitably a ribbon burner and is arranged to fire into a water cooled combustion chamber having a heat exchanger 5 through which water flows from an inlet side 6 to an outlet side 7 for supply to domestic hot water services, or for space heating radiators. The outlet side 7 suitably has a water temperature sensor or thermostat 8. A flue 9 is provided for the discharge of combustion products and an oxygen sensor 10 is arranged in the flow path of the combustion products.

Suitably the oxygen sensor is a zirconia sensor arranged to operate in the amperometric mode such that the limiting electrical current passing through the sensor is substantially proportional to the oxygen partial pressure in the flue gases. Alternatively, other means of aeration sensing may be used.

The oxygen sensor is arranged to supply an analogue signal indicative of excess oxygen in the combustion products through an analogue to digital converter 11 to a microprocessor based control unit 12. The control unit 12 is controlled by a control programme 13, to be described below, and is arranged in controlled manner to operate a spark generator 15 via a relay 14 for burner ignition, a gas on/off valve 16, situated in the gas supply upstream of the modulating valve 2, via a relay 17, and to control the modulating valve 2 and the fan speed control 4 via respective digital to analogue converters 18,19.

A monitoring terminal 20 may be associated with the control unit 12 for set up or programme change purposes.

A flame sensor 21 is suitably arranged at the burner 1 to supply an indication to the control unit of ignition or flame-out.

The control unit is suitably arranged to respond to an initial load requirement and to operate the spark generator 15 and gas on/off valve 16 to effect ignition with the modulating valve 2 and fan speed control 4 at appropriate start up settings.

The control programme 13 is adapted to cause the control unit to perform the steps set out in the flow charges of FIGS. 2-5.

The monitoring terminal 20 is provided to enable the control programme to be monitored and modified if desired. However, in most installations a monitor will be unnecessary and the relevant programmes will be stored in a non volatile EPROM in the control unit.

Figure 2:
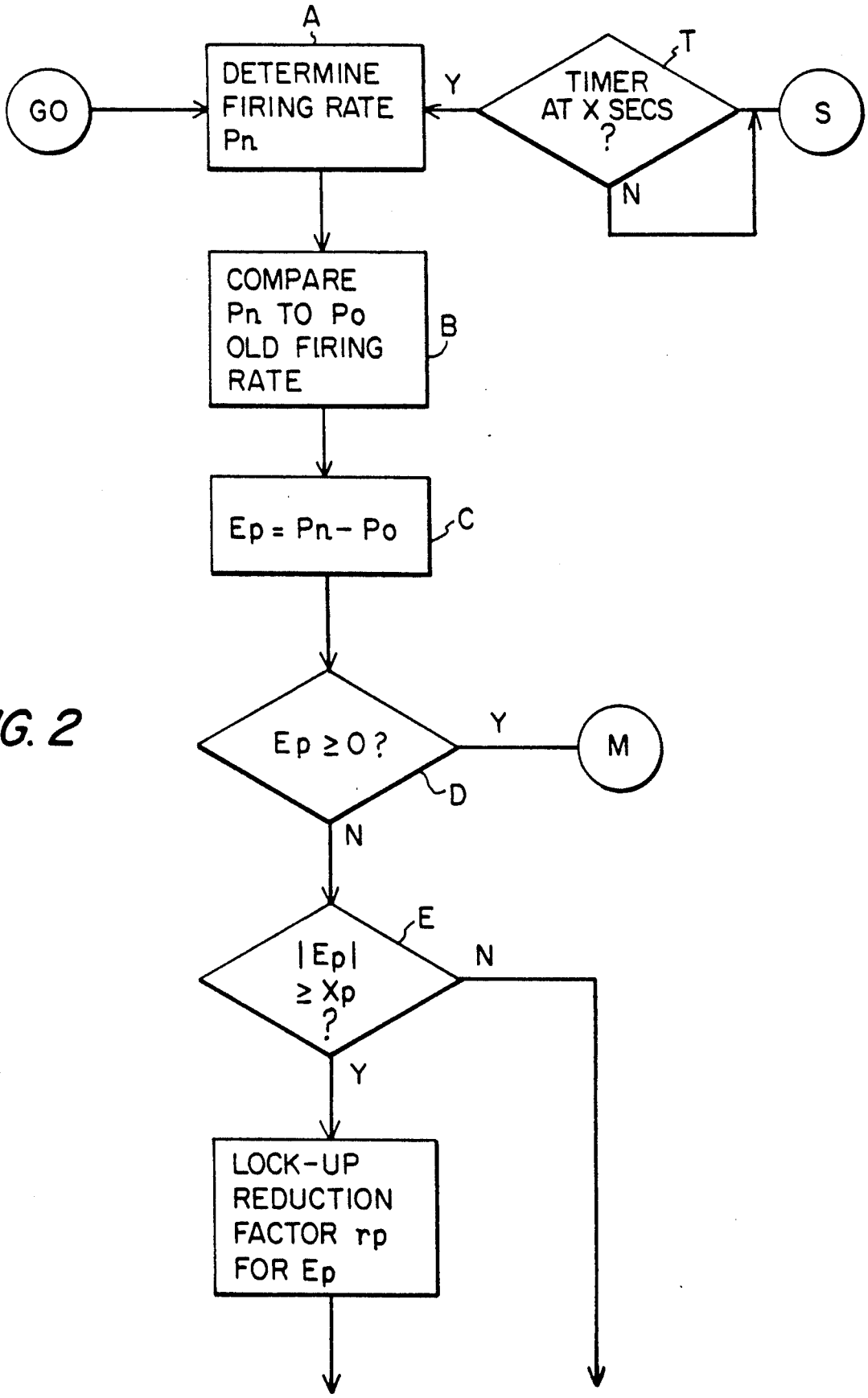
FIGS. 2 to 5 are successive parts of a control programme flow chart for the controller of the system of FIG. 1.

Referring to FIG. 2 the stage A represents a starting condition after ignition and flame detection have been achieved and the burner flame is in stable condition. There is continuous monitoring of the flame by sensor 21 and the control programme is arranged to cause the controller to effect shut-down should flame failure be detected. At point A the desired burner firing rate Pn is determined at intervals clocked by a timer T; this will be according to the heating application for which the installation is being used and may, for example, be in response to the outlet water temperature sensed at thermostat 8 in relation to a desired temperature. At B the desired firing rate is compared with the existing firing rate Po to establish at C a firing rate error:

$$Ep = Pn - Po$$

Figure 5:
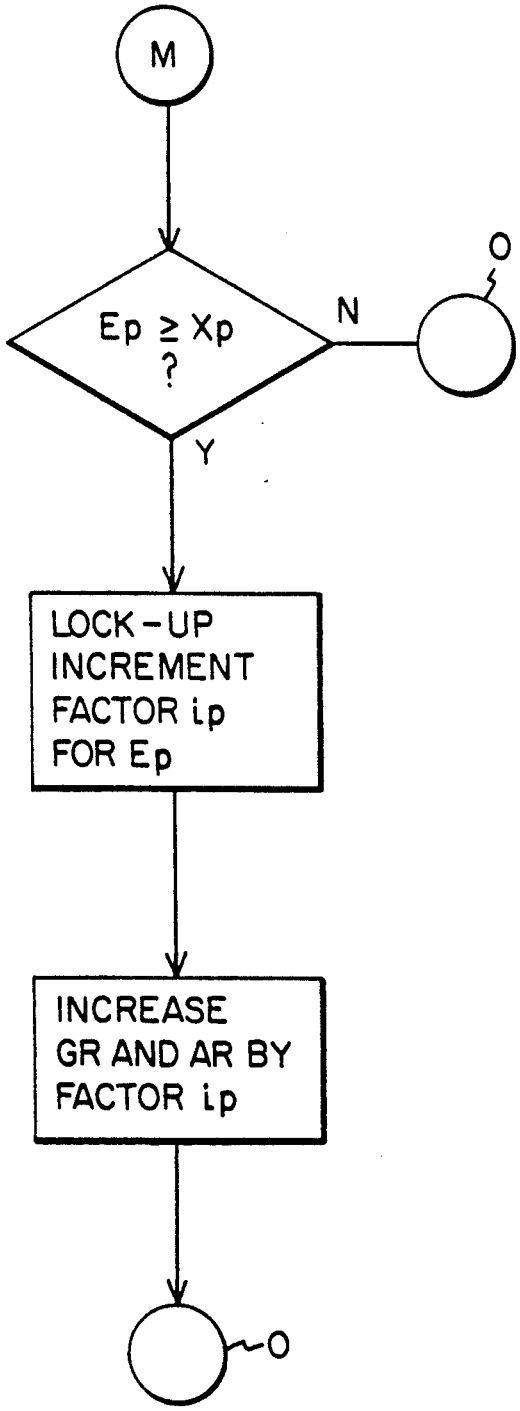

At stage D it is determined whether the error Ep is positive, indicating requirement for an increase in firing rate, and if so the flow chart moves to point M in FIG. 5. If Ep is negative the flow chart proceeds to point E where the modulus of Ep is compared to a preprogrammed breakpoint Xp set such that if Xp is exceeded such a large reduction in firing rate is required that the gas and air rates must be reduced simultaneously to prevent combustion instability. If Xp is exceeded the flow chart moves to point F in FIG. 3 whereby the control unit causes the gas modulating valve 2 and fan speed control simultaneously to reduce the gas and air rates respectively in gaslike manner by a fractional factor rp related to the magnitude of Ep, such that at stage G the firing rate is set at the desired level Pn. The fractional factor rp, is determined from a stored table of empirical data of rp/EP.

The control un then establishes a suitable aeration, λ for the firing rate Pn from a stored table containing suitable oxygen concentrations at different firing rates and established empirically. For example with metal fully premixed burner, higher aerations will be required at low heat inputs to extend the burner operating range, and the stored table will contain data relevant to the particular burner used.

Figure 4:
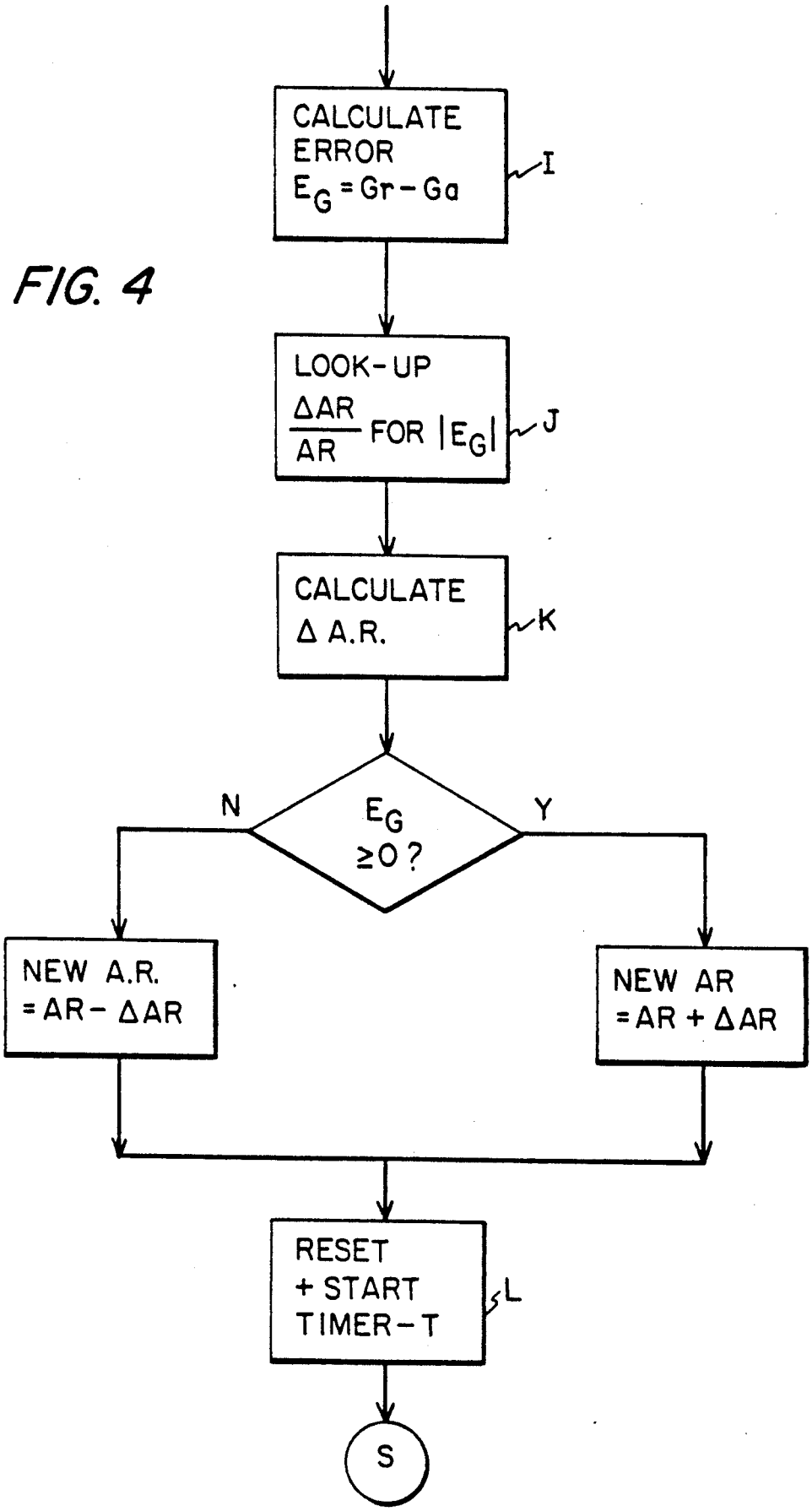

At stage H the flue gas oxygen concentration Gr corresponding to the desired aeration λ is established and is compared with the oxygen concentration Ga measured by the sensor 10 and an error signal EG determined by subtraction $$EG = Gr - Ga$$

as indicated at stage I in FIG. 4. A fractional air rate differential ΔAR/AR is then picked, at stage J, from a stored table of fractional air rate differential against flue gas oxygen error established empirically. ΔAR is then calculated at stage K by applying the fractional air rate differential to the present air rate setting i.e. the present digital control setting of the fan speed control 4. This method of calculating the proportional change in the air rate does not need to have information about the present air rate for or within the stored table. The table ensures an identical approach profile to the zero-error point irrespective of the actual air rate and the sign of the oxygen error, and provides a floating control.

If the oxygen error is positive indicating that the required flue gas oxygen concentration is greater than the actual concentration, ΔAR is added to the present air rate signal to the fan speed control 4. If EG is negative, ΔAR is subtracted from the present air rate signal.

At point S, the control action having been taken, the timer T of FIG. 2 is reset to zero and started. The timer is arranged as shown in FIG. 2 in relating to stage A to ensure that once a control action has been taken there is a predetermined delay of X seconds before a further control action is taken to ensure stability within the system. Typically a delay X of between 1 and 5 seconds is suitable.

Referring back to FIG. 2, if at stage D the power error is positive, i.e.

$$Ep \geqq 0$$

the programme moves to point M in FIG. 5 and the power error Ep is compared with Xp. If EP≧Xp the air and gas rates are increased simultaneously in gas-led manner by a fractional factor ip related to the magnitude of Ep in a predetermined manner from stored data of ip against Ep established empirically. Similarly to the negative power error situation, this action ensures combustion stability on the premixed burner.

Figure 3:
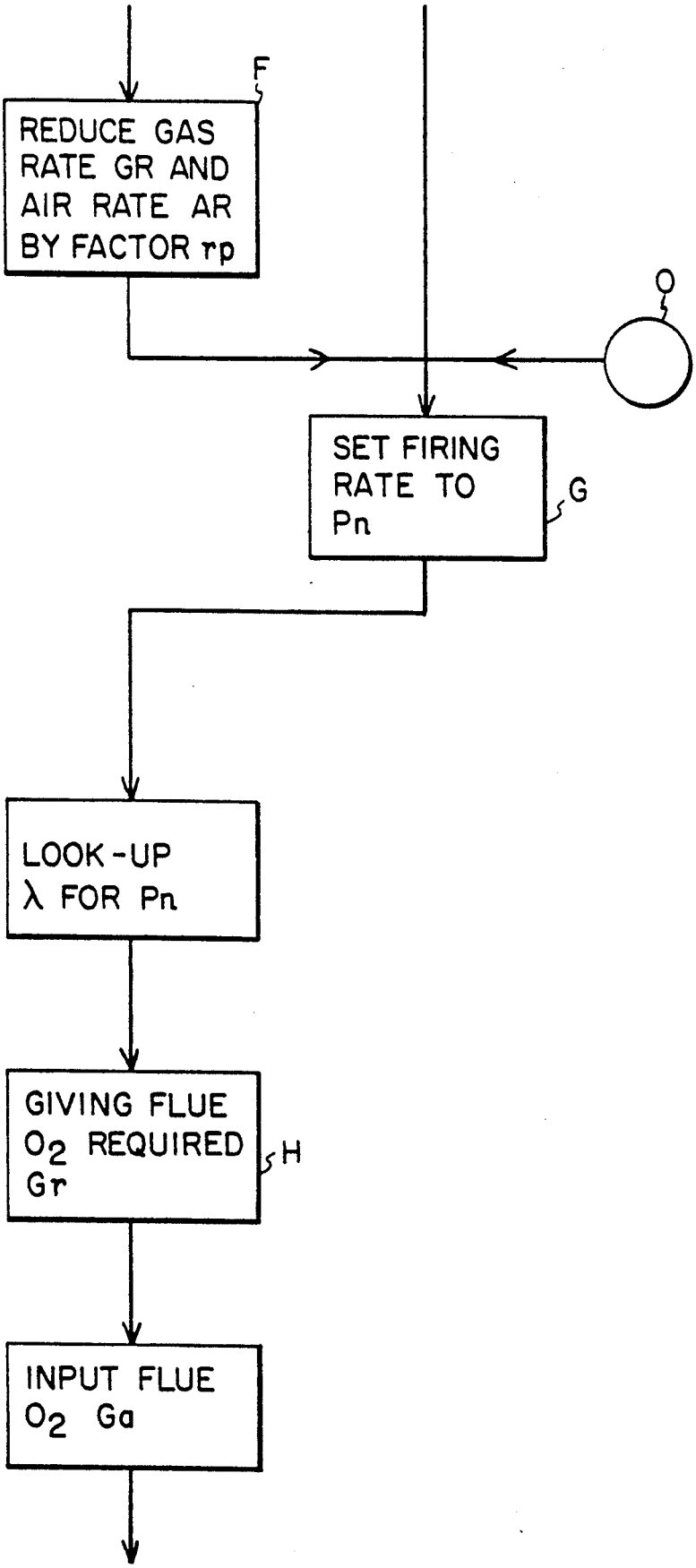

If the power error at M is less than Xp, i.e.

$$Ep < Xp$$

the programme returns to point O in FIG. 3.

The reason for comparison of (Ep) with the breakpoint Xp is to determine whether the power error Ep is sufficiently large for a large estimated reduction in power to be made, in order to obtain a fast control action, and then subsequently to be connected, by means of reducing Ep to zero by a slow control action in response to the flue gas oxygen content Gr, or whether Ep is sufficiently small for the correction to be made immediately without the need for the intervening estimation step. This process ensures that under large control error situations a fast control action is made to be corrected subsequently at a slower pace.

Figure 6:
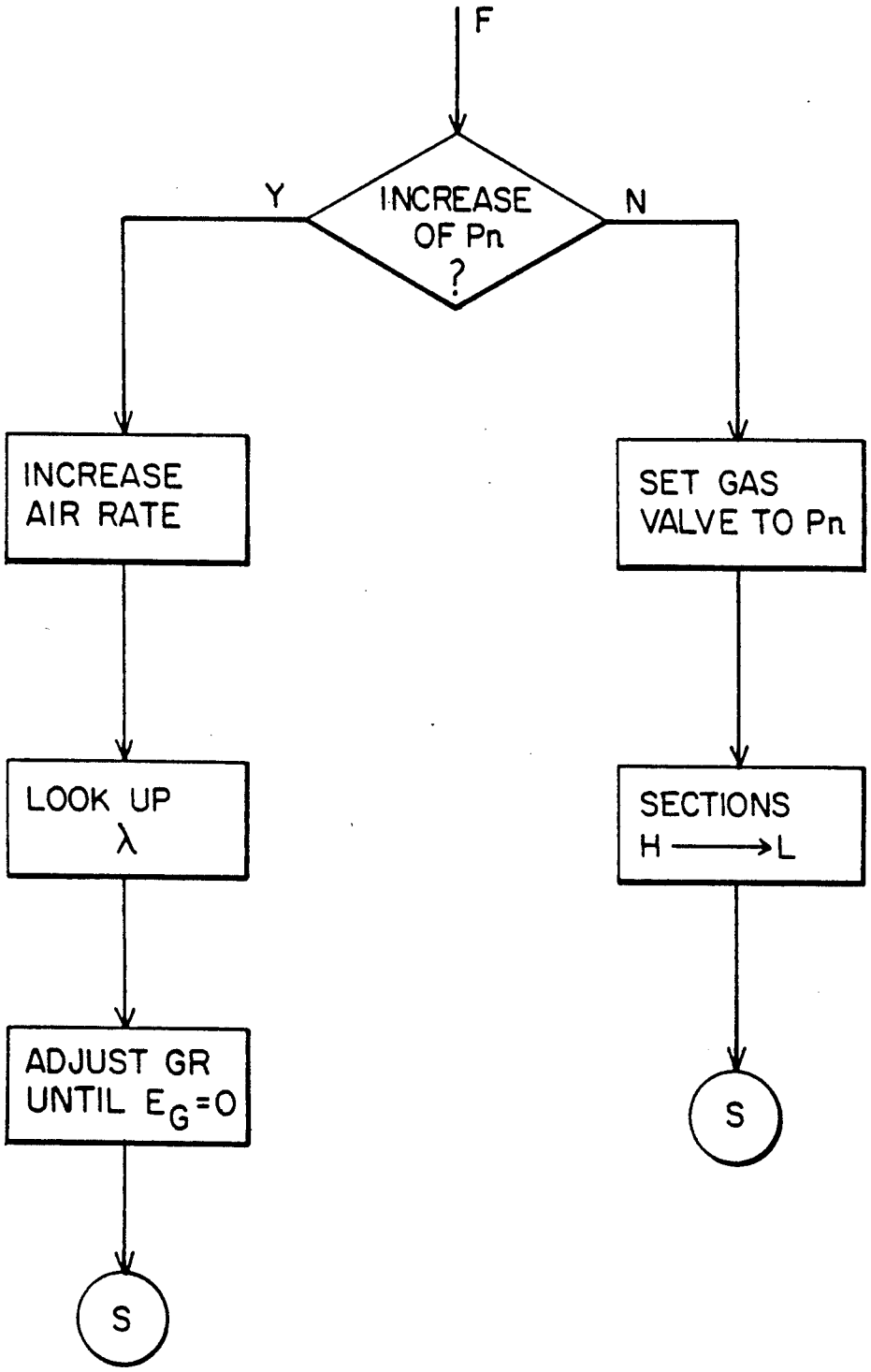
FIG. 6 is an alternative to part of the flow chart of FIGS. 3 and 4.

At stage G, the power when being reduced is automatically in a gas-led situation as a consequence of stages H to L. When the power is being increased at Stage G as a consequence of the steps of FIG. 5, the flow chart assumes a small error in Pn, large errors already having been dealt with in air appropriate fashion. As a consequence of the error being small it is deemed that all control action will be safe, whether increasing or decreasing Pn, if they are made in gas-led manner, and the break point Xp is set accordingly. This does not apply to large errors in Pn which must be dealt with as described above to ensure a fast, safe control. In certain systems it may be desirable to adopt an air-led system for increasing Pn and gas-led for decreasing Pn, for all errors in Pn whether large or small, as shown in the alternative flow chart of FIG. 6 in which after stage F, FIG. 3, a determination is made as to whether firing rate Pn is to be increased or decreased. If yes, the firing rate is increased in air-led manner, a suitable aeration is established from the look-up table and the gas rate Gr is adjusted EG=0 through similar steps to stages H to L of FIGS. 3 and 4 but adjusting gas instead of air. If no, i.e. a decrease is required, the firing rate is decreased in gas-led manner by setting the gas valve to meet Pn and then following sections H to L of FIGS. 3 and 4 as described above.

Figure 7:
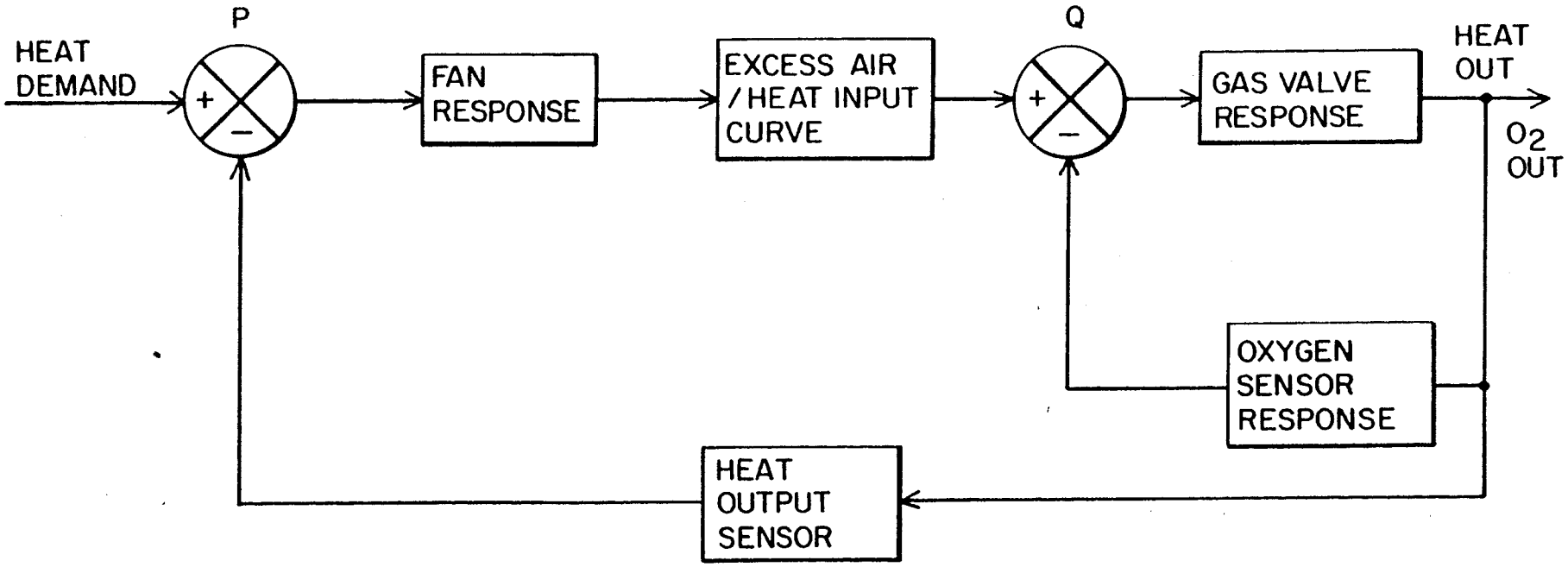
FIG. 7 is a block diagram illustrating the control strategy of the control programme of FIGS. 2–6.

The control strategy of the system is represented by the block diagram of FIG. 7 where an externally derived heat demand signal is compared at point P to a system generated signal representing the heat output and which may, for example, be derived from a flow water temperature sensor, a water mass flow sensor and a temperature sensor, or a gas flow sensor depending on the type of appliance with which the system is used, and its application. The comparison of these two signals gives rise to an error signal which in an air led mode produces a proportional change in fan speed until the error is zero, at which the fan speed is held constant. At Q the gas valve is then controlled in response to empirical data of optimum excess oxygen against heat demand, compared with actual excess oxygen sensed in the flue gases by an oxygen sensor to produce an error signal for adjusting the gas valve.

Under certain circumstances, for example in rapid response situations, it may be desirable for safety reasons to operate as an air led system when the heat demand increases and a gas led system when demand falls. Thus in a gas led mode the air rate is altered in response to an error signal at Q. From a knowledge of the dynamic, time dependent characteristics of the system components it is possible to predict their cumulative effect with an alteration of the controlling input at point P and it is possible to embody delays and compensating factors at the points P and Q at which the system controller has an effect to ensure that an operating installation is stable and non-oscillatory, but accurate and fast acting.

It will be appreciated that if the supply gas composition varies, both the Wobbe Number and the combustion air requirement can alter. By a suitable choice of heat output sensor, the effect of a varying Wobbe Number on the heat output can, if necessary, be compensated. Also the effect of varying combustion air requirements on excess air can be negated with this system.

Whilst the invention has been described in relation to the control of a gas burner installation, it can be applied in similar manner to installations incorporating burners of fuels other than gas.

What is claimed is:

1. A method of controlling a fuel burner by means of a programmed control unit adapted to modulate supplies of fuel and air to the burner, comprising the steps of:

(a) establishing an input Pn to the control unit which is representative of a required firing rate;

(b) establishing an input Po to the control unit which is representative of the existing firing rate;

(c) establishing in the control unit an error Ep, where $Ep = Pn - Po$;

(d) determining in the control unit whether Ep is positive or negative, thereby indicating whether an increase or decrease in firing rate is required in order to set the firing rate at Pn;

(e) if Ep is positive, modulating the fuel and air supplies to the burner in air led manner to set the firing rate to Pn;

(f) if Ep is negative, modulating the fuel and air supplies to the burner in fuel led manner to set the firing rate to Pn;

(g) comparing Ep with a predetermined bread point Xp and, if $/Ep/ \geqq Xp$, modulating the fuel and air supplies to the burner simultaneously;

(h) establishing an input Ga representative of the flue gas oxygen concentration;

(i) establishing an error EG by subtracting Ga from stored data representative of desired oxygen concentration Gr at desired firing rates Pn;

(j) comparing EG to stored data representative of a fractional air-rate differential $\Delta AR/AR$ against EG, where $\Delta AR$ is the desired change in air flow and AR is the air flow to the burner; and (k) modulating the existing air flow as dictated by the relevant $\Delta AR/AR$ to correct the oxygen concentration.

2. A method according to claim 1 wherein said control unit is timed such that once a control action is taken there is a predetermined delay X, in seconds, before a further control action is taken.

3. A method according to claim 1 wherein said fuel burner is a gas burner.

4. A method according to claim 1 wherein, if $/Ep/ \geqq Xp$, the fuel and air supplies to the burner are modulated by a reduction factor rp or an increase factor ip related to the magnitude of Ep.

5. A method of controlling a fuel burner by means of a programmed control unit adapted to modulate supplies of fuel and air to the burner, comprising the steps of:

(a) establishing an input Pn to the control unit which is representative of a required firing rate;

(b) establishing an input Po to the control unit which is representative of the existing firing rate;

(c) establishing in the control unit an error Ep, where $Ep = Pn - Po$;

(d) determining in the control unit whether Ep is positive or negative, thereby indicating whether an increase or decrease in firing rate is required in order to set the firing rate at Pn;

(e) if Ep is positive, modulating the fuel and air supplies to the burner in air led manner to set the firing rate to Pn;

(f) if Ep is negative, modulating the fuel and air supplies to the burner in fuel led manner to set the firing rate to Pn;

(g) establishing an input Ga representative of the flue gas oxygen concentration;

(h) establishing an error EG by subtracting Ga from stored data representative of desired oxygen concentration Gr at desired firing rates Pn;

(i) comparing EG to stored date representative of a fractional air-rate differential $\Delta AR/AR$ against EG, where $\Delta AR$ is the desired change in air flow and AR is the air flow to the burner; and (j) modulating the existing air supply to the burner as dictated by the relevant $\Delta AR/AR$ to correct the oxygen concentration.

6. A fuel burner installation, comprising:

a fuel burner;

means for supplying air to said burner;

means for supplying fuel to said burner;

means for modulating the air supply to said burner;

means for modulating the fuel supply to said burner;

a programmed control unit adapted to modulate fuel and air supplied to said burner by control of said modulating means;

means for establishing an input Pn to the control unit which is representative of a required firing rate of the burner;

means for establishing an input Po to the control unit which is representative of the existing firing rate of the burner;

oxygen concentration sensor means positioned in a flue gas path of said burner adapted to input to said control unit an input Ga representative of the flue gas concentration;

said control unit being programmably adapted to (1) establish an error $Ep=Pn-Po$, and depending upon whether Ep is positive or negative, to increase the fuel and air supplied to the burner, by said modulating means, in an air-led or fuel-led manner, respectively, to set the firing rate to Pn; (2) compare Ep with a predetermined break point Xp and, if $/Ep/\geqq Xp$, to modulate the air and fuel supplies to the burner simultaneously; and (3) to establish an error EG by subtracting Ga from stored date representative of desired oxygen concentrations GR at desired firing rates Pn, compare the error EG to stored date representative of a fractional air-rate differential $\Delta AR/AR$ against EG, where $\Delta AR$ is the desired change in air flow and AR is the air flow to the burner, and to modulate the existing air flow to the burner as dictated by the relevant $\Delta AR/AR$ to correct the oxygen concentration.

7. An installation according to claim 6 wherein the modulation of air and fuel supplies to the burner simultaneously when $/EP/\geqq Xp$ is by a reduction factor rp or an increase factor ip related to the magnitude of Ep.

8. An installation according to claim 6 wherein said fuel burner is a gas burner.

9. A fuel burner installation, comprising:

a fuel burner;

a flue gas path;

means for supplying air to said burner;

means for supplying fuel to said burner;

means for modulating the supply of air to said burner;

means for modulating the supply of fuel to said burner;

a programmed control unit adapted to modulate fuel and air supplies to said burner by control of said modulating means;

means for establishing an input Pn to the control unit which is representative of a required firing rate of the burner;

means for establishing an input Po to the control unit which is representative of the existing firing rate of the burner;

oxygen concentration sensor means positioned in said flue gas path an adapted to input to said control unit an input Ga representative of the flue gas concentration;

said control unit being programmably adapted to (1) establish an error $Ep=Pn-Po$, and, depending upon whether Ep is positive or negative, to increase the fuel and air supplies to the burner in air-led or fuel-led manner, respectively, to set the firing rate to Pn; and (2) to establish an error EG by subtracting Ga from stored data representative of desired oxygen concentration Gr at desired firing rates Pn, compare the error EG to stored data representative of a fractional air-rate differential $\Delta AR/AR$ against EG, where $\Delta AR$ is the desired change in air flow and AR is the air flow to the burner, and to modulate the existing air flow to the burner as dictated by the relevant $\Delta AR/AR$ to correct the oxygen concentration.

* * * * *